US005509683A

United States Patent [19]

Daniel

[11] Patent Number: 5,509,683

[45] Date of Patent: Apr. 23, 1996

[54] BRAKE ASSEMBLY FOR SNOW SKIS AND SNOW BOARDS

[76] Inventor: Dorce L. Daniel, 1101 W. L, Benicia, Calif. 94510

[21] Appl. No.: 533,255

[22] Filed: Sep. 25, 1995

[51] Int. Cl.[6] ..... A63C 7/10

[52] U.S. Cl. ..... 280/605; 280/28.11; 280/809

[58] Field of Search ..... 280/604, 605, 280/28.11, 809, 816; 188/8, 128

[56] References Cited

U.S. PATENT DOCUMENTS

| | | | |
|---|---|---|---|
| 2,194,979 | 3/1940 | Jett | 280/605 |
| 3,794,339 | 2/1974 | Smolka | 280/612 |
| 3,909,024 | 9/1975 | Salomon | 280/605 |
| 4,152,007 | 5/1979 | Smith | 280/605 |
| 4,279,433 | 7/1981 | Petaja | 280/605 |
| 4,342,468 | 8/1982 | Beyl | 280/605 |

FOREIGN PATENT DOCUMENTS

| | | | |
|---|---|---|---|
| 2476496 | 8/1981 | France | 280/605 |
| 0652038 | 10/1985 | Switzerland | 280/605 |

*Primary Examiner*—Brian L. Johnson
*Attorney, Agent, or Firm*—Flehr, Hohbach, Test, Albritton & Herbert

[57] ABSTRACT

A ski brake assembly (21, 21*a*) for snow skis (24) or snow boards (24*a*). The ski brake assembly includes a framework (22) to which a snow-engaging braking blade assembly (26, 26*a*) is mounted for movement between a retracted position and a plurality of braking positions. The braking blade (26, 26*a*) is driven by an electric motor (36) through a blade drive assembly (51) formed to displace the blade (26, 26*a*) in response to operation of the motor (36). The drive assembly (51) and motor (36) are formed to hold the braking blade (26, 26*a*) in a selected one of a plurality of braking positions against the snow when the manually-operated switch assembly (42, 42*a*) is released. The control circuit (39) is coupled to the switch assembly (42, 42*a*) so as to switch polarity of the motor (36) for driving the motor (36) in opposite directions. Moreover, the electrical circuit (39) terminates operation of the motor (36) substantially immediately on release of the switch (42, 42*a*) so that, in combination with a wormgear drive (52) and reduction gears (62), the braking blade (26, 26*a*) is stopped immediately and held at virtually any selected braking position.

11 Claims, 5 Drawing Sheets

BRAKE ASSEMBLY FOR SNOW SKIS AND SNOW BOARDS

TECHNICAL FIELD

The present invention relates, in general, to ski brakes of the type that can be used in connection with snow skis, and more particularly, relates to a ski brake assembly which can be used by a skier or snow boarder to slow movement of the skis or snow board over the snow while skiing.

BACKGROUND ART

Considerable effort has been directed toward the provision of ski brakes which are actuated upon release of the skier's boot from the binding. Such brakes typically include a moveable blade or blades that are driven down into the snow when the boot releases from the binding. The ski brake prevents the ski from travelling wildly down the hill endangering other skiers and making retrieval difficult. It is known to assist binding release using an electric motor, as shown in U.S. Pat. No 3,794,339, and various spring-biased and cam-actuated schemes for driving the braking blades into the snow after the boot is released have been devised. Typical of such ski brake apparatus are the devices shown in U.S. Pat. Nos. 3,909,024, 4,279,433 and 4,342,468.

Binding-release ski brakes, however, are not designed to operate while the skier is skiing. Thus, they do not assist the skier controlling his or her descent, and they cannot be applied by the skier intentionally while staying in the ski bindings.

Nevertheless, one of the problems which is most common for beginner skiers and beginner snow boarders is an inability to control their speed on skis or snow boards. As a result of this inability, there is considerable "fear of the fall line" in which beginner skiers do not point their skis or snow board directly downhill or along the fall line. Conventionally, braking of snow skis and snow boards is accomplished by using turning techniques in which the edges of the skis, or snow board, are tilted into the snow to effect braking. In connection with both skis and snow boards, these turning techniques can be initially difficult and awkward to learn, and many novice skiers become discouraged and give up the sport because of their inability to develop effective braking techniques.

The problem of snow ski braking during skiing has been addressed using a hydraulic ski brake assembly. U. S. Pat. No. 4,152,007 discloses a hydraulic ski brake assembly in which a pivotally mounted blade or scoop can be driven down into the snow by hydraulic actuators which are pressurized by hand-held pumps. The hydraulic brake assembly of U.S. Pat. No. 4,152,007 allows the skier to selectively apply a braking force while skiing, but inherently it also has several disadvantages.

First, the use of a hydraulic system is undesirable in light of the ease with which the hydraulic lines can become severed or damaged as a result of falls taken while skiing. If hydraulic lines are severed, the further problem of the discharge of hydraulic fluid, a notorious contaminant, onto the snow is created. Moreover, and very importantly, the hydraulic system of U.S. Pat. No. 4,152,007 requires that the hand-grip pump assemblies be held while the braking force is applied. Thus, the skier must continue to grip the hand-held pumps in order to prevent the brake from releasing or pivoting rearwardly out of the snow. This is highly undesirable because, for the beginning skier, it is desirable to have some braking force applied all of the time during skiing, and the beginning skier will want to use his arms and hands for balance. This makes the gripping and maintenance of a positive force on the hydraulic pump or cylinder assembly, while skiing, rather awkward. Moreover, the hydraulic actuator assembly of U.S. Pat. No. 4,152,007 is not constructed in a manner which easily allows control of the depth to which the brake are driven into the snow. Thus, it is difficult for a novice skier to control the amount of braking force being applied, particularly under dynamic skiing conditions.

Accordingly, it is an object of the present invention to provide a ski brake assembly of the type which can be used during skiing to control descent of the skier on a pair of skis or a snow board.

It is a further object of the present invention to provide a ski brake assembly which will enable rapid and yet fine adjustments of the braking force to be easily made and held under dynamic skiing conditions.

Another object of the present invention is to provide a brake assembly for skis or a snow board which can be easily mounted to the body of the ski or snow board and is constructed in a manner which is easy to operate and frees the skier's hands for dynamic balancing.

A still further object of the present invention is to provide a brake assembly for skis or a snow board which is compact, easy to operate, durable and inexpensive to construct.

The ski and snow board brake assembly of the present invention has other objects and features of advantage which will become apparent from, and are set forth in more detail, in the accompanying drawing and the following Description of the Best Mode of Carrying Out the Invention.

DISCLOSURE OF INVENTION

The brake assembly for snow skis or snow boards of the present invention is comprised, briefly, of a framework formed for mounting to the body of a ski board or skis proximate a rear-end thereof; a snow-engaging braking blade mounted for movement between a retracted position and a plurality of braking positions in which a blade is in contact with the snow and oriented to effect braking; an electrical motor; a battery electrically connected to the electrical motor; a switch assembly and electrical circuit electrically coupled to control operation of the motor by manual gripping and operation of the switch assembly while skiing; and a blade drive assembly coupled between the electrical motor and the braking blade and formed to displace the braking blade between the retracted position and the braking positions in response to operation of the motor. The blade drive assembly and electrical motor are formed to hold the braking blade in the selected one of the braking positions against snow-induced braking forces after operation of the electrical motor has terminated. This allows what amounts to hands-free continued operation of the brake and rather minute changes in the braking force to be easily accomplished. In the preferred form, the drive assembly includes a worm gear mounted for rotation to the framework and a drive nut threadably mounted on the worm gear for displacement on the worm gear. A link member couples the drive nut to the braking blade, and the worm gear preferably is driven by a set of reduction gears mounted between the motor and the worm gear. The electrical circuit is constructed and coupled to double pole, double throw switch so as to reverse plurality of the motor to drive the motor and the blade toward either the braking or retracted positions. The switch is biased to a position which effects short circuiting of the motor windings so as to immediately stop or terminate operation of the motor, which combines with the reduction gears and worm gear to prevent inertial displacement of the drive assembly and overrun of the travel of the braking blade.

BEST MODE OF CARRYING OUT THE INVENTION

The ski brake assembly of the present invention allows the skier to easily adjust the snow-engaging braking blade through any one of a plurality of depths so as to control the amount of braking which is occurring while skiing. Moreover, the present braking assembly enables adjustments to be minor in amount and essentially frees the skier's hands for dynamic balancing once the braking force has been adjusted or selected.

Figure 1:
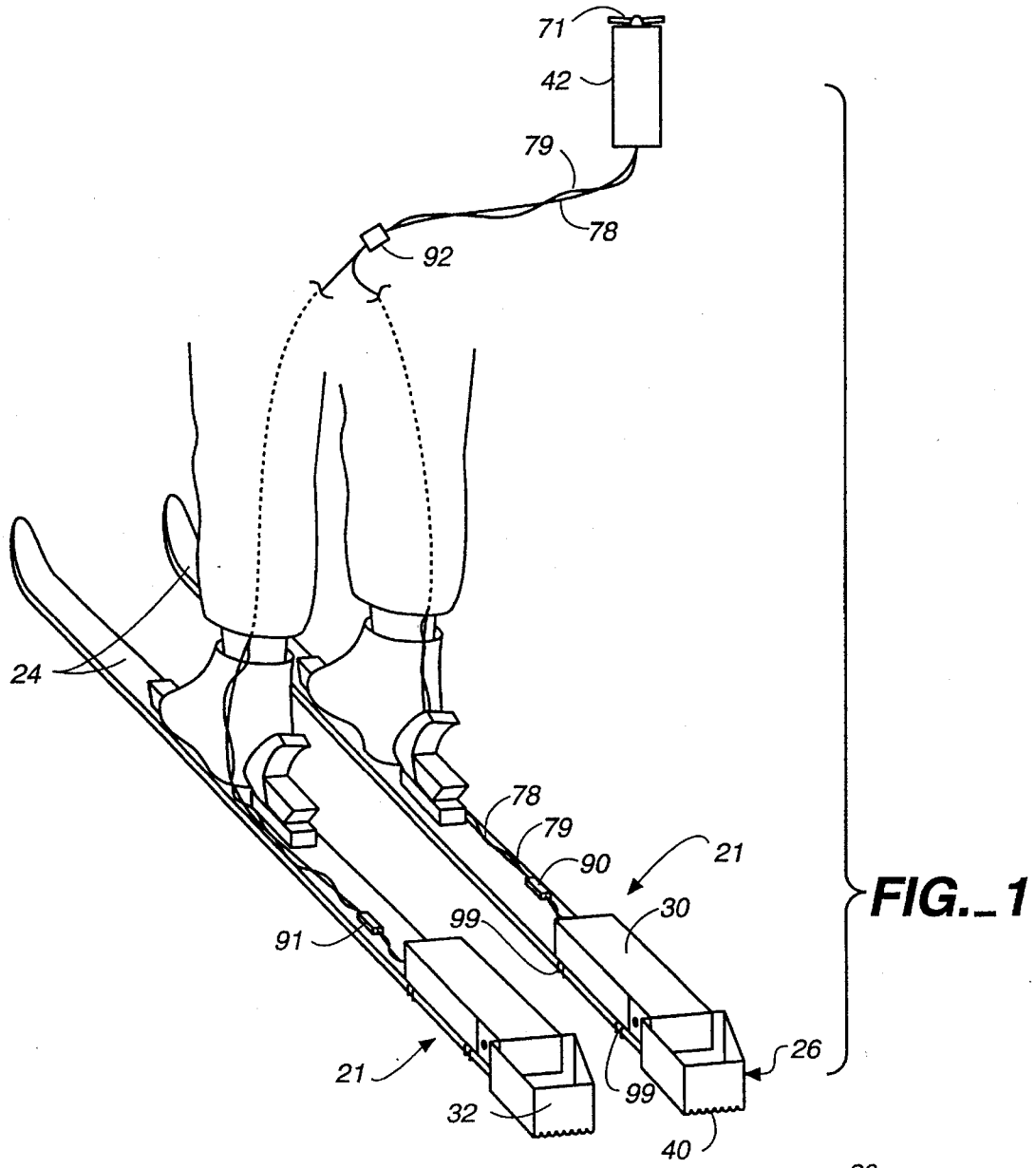
FIG. 1 is a top perspective view of a pair of snow skis having a brake assembly constructed in accordance with the present invention mounted thereto.
Figure 4:
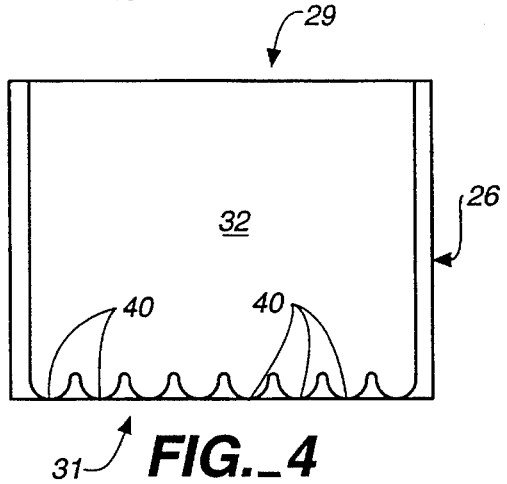
FIG. 4 is an end elevation view of the braking blade taken substantially along the plane of line 4—4 in FIG. 2.
Figure 2:
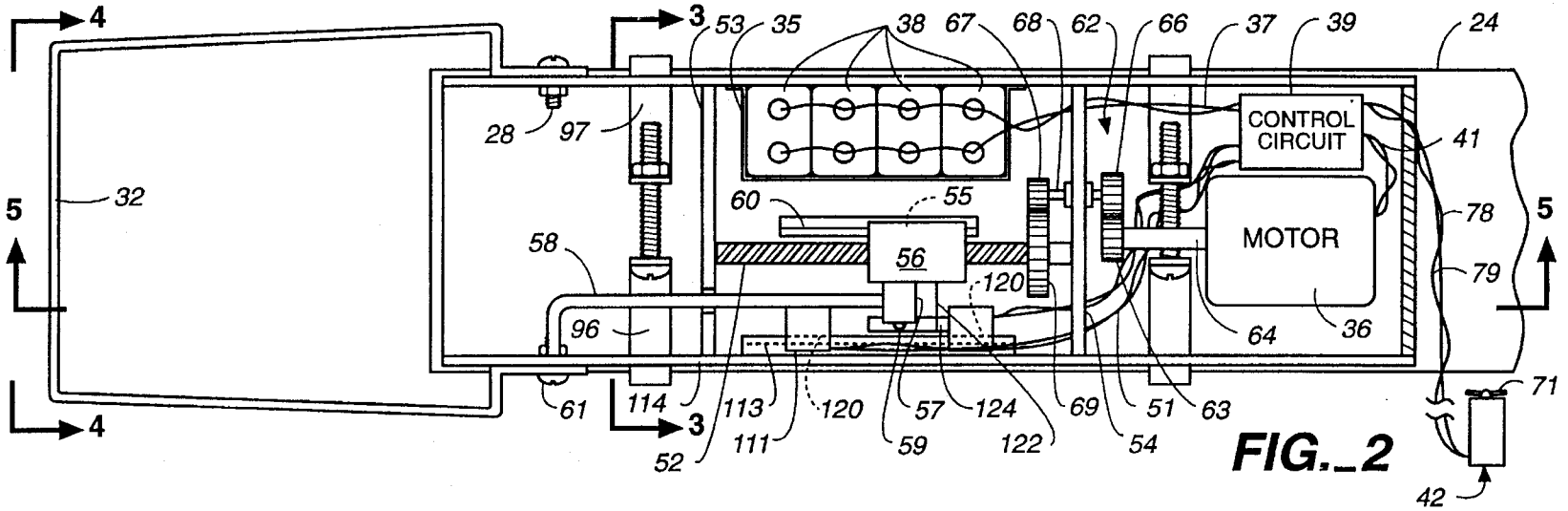
FIG. 2 is an enlarged, top plan view of the brake assembly of FIG. 1 with the housing removed and the braking blade in a retracted position.
Figure 5:
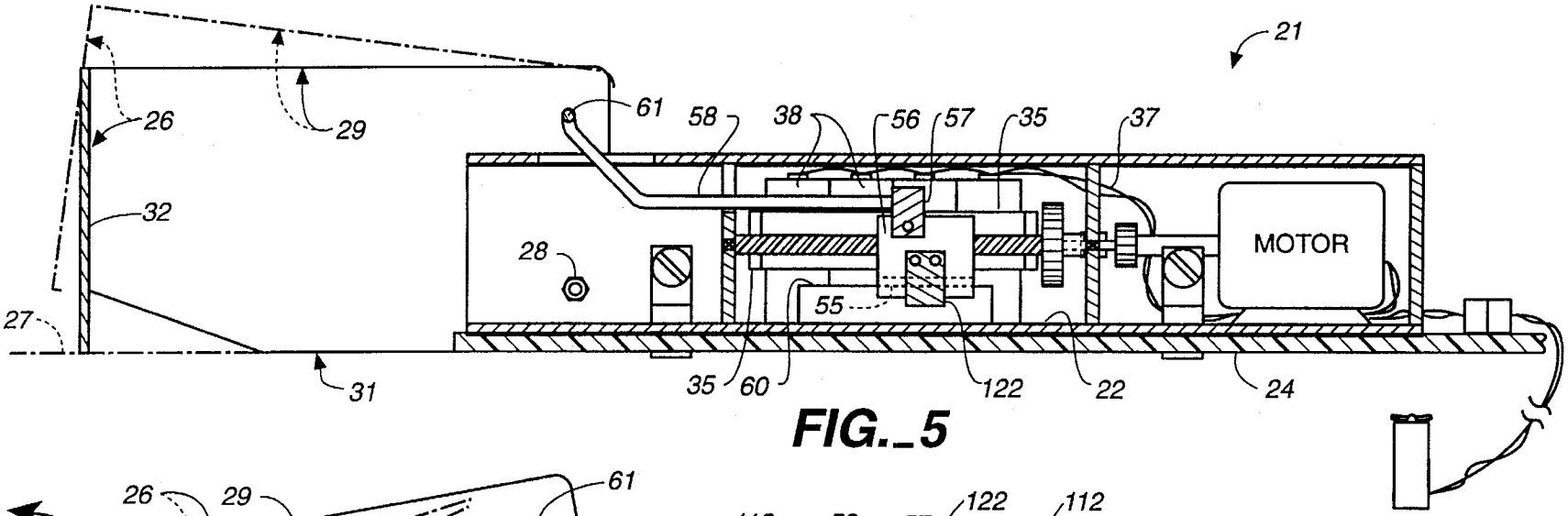
FIG. 5 is a side elevation view in cross-section, corresponding to FIG. 2 and taken substantially along the plane of line 5—5 in FIG. 2.

Referring now to FIGS. 2 and 5, the brake assembly of the present invention, generally designated 21, can be seen to be comprised of a framework 22 which is formed for mounting to the body of snow skis or a snow board. In the form of the invention shown in FIGS. 1 through 5, the brake assembly is designed for use on snow skis 24, while in the form of the invention shown in FIG. 7, brake assembly 21*a* is shown mounted to the body of a snow board 24*a*.

Figure 2A:
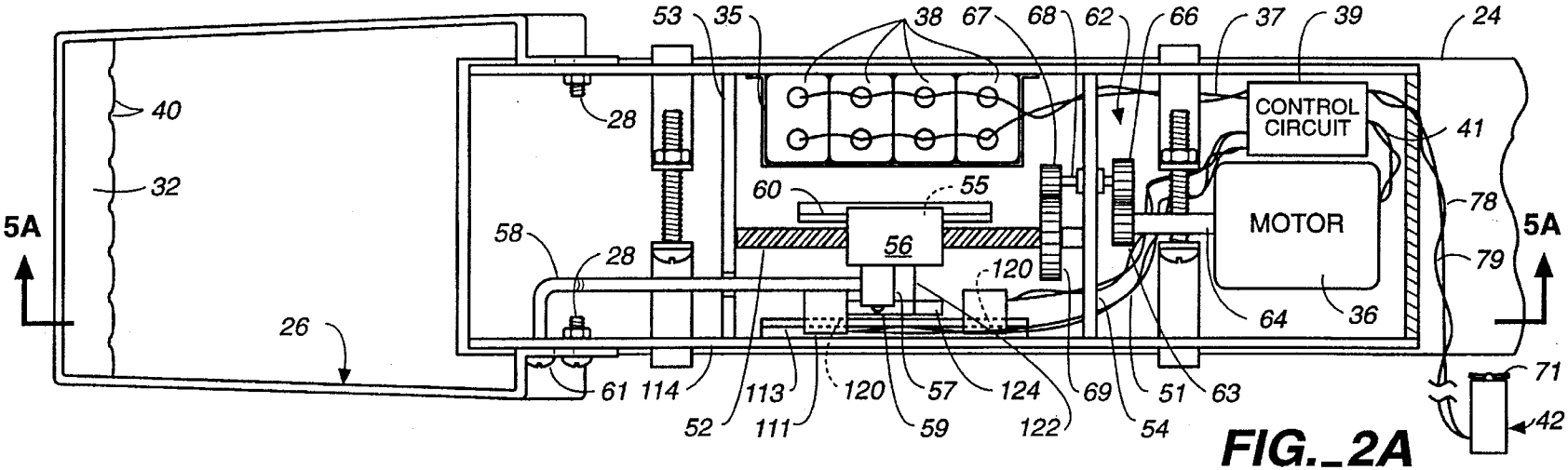
FIG. 2A is a top plan view corresponding to FIG. 2 showing the braking blade in a braking position.

In order to effect braking of skis 24 or snow board 24*a*, brake assembly 21, 21*a* includes a snow-engaging braking blade or scoop, generally designated 26, mounted to one of framework 22 or directly to skis 24 or snow board 24*a*. In the preferred and illustrated form, blade assembly 26 is mounted to framework 22 so that the brake of the present invention can be easily mounted to the ski or snow board. The braking blade is mounted for movement between a retracted position, shown in FIGS. 2 and 5, in which braking blade 26 is essentially out of contact with snow surface 27 and a plurality of braking positions, shown in FIGS. 2A and 5A, in which braking blade 26 is in contact with snow surface 27 and oriented to effect braking. The most preferred braking orientation is shown in the drawings, namely, a portion 32 of blade assembly 26 is oriented transverse to the direction of motion of the skis or snow board.

In the most preferred form of blade assembly 26, the blade is formed as a general U-shaped scoop which is pivoted at 28 to framework 22 for movement between the retracted and braking positions. As will be seen from FIGS. 2 and 5, the blade or scoop has an open top or upper side 29, as well as an open bottom or lower side 31, so that only the closed end 32 produces braking. Snow engaged by end 32 is allowed to pass up, over and out of the opened top 29 of the scoop, as indicated by arrow 33. As can be seen in FIG. 4, protrusions or scallops 40 can be provided on the lower edge of blade wall 32. It will be understood, however, that other forms of snow-engaging braking blades 26 can be employed within the scope of the present invention.

Figure 5A:
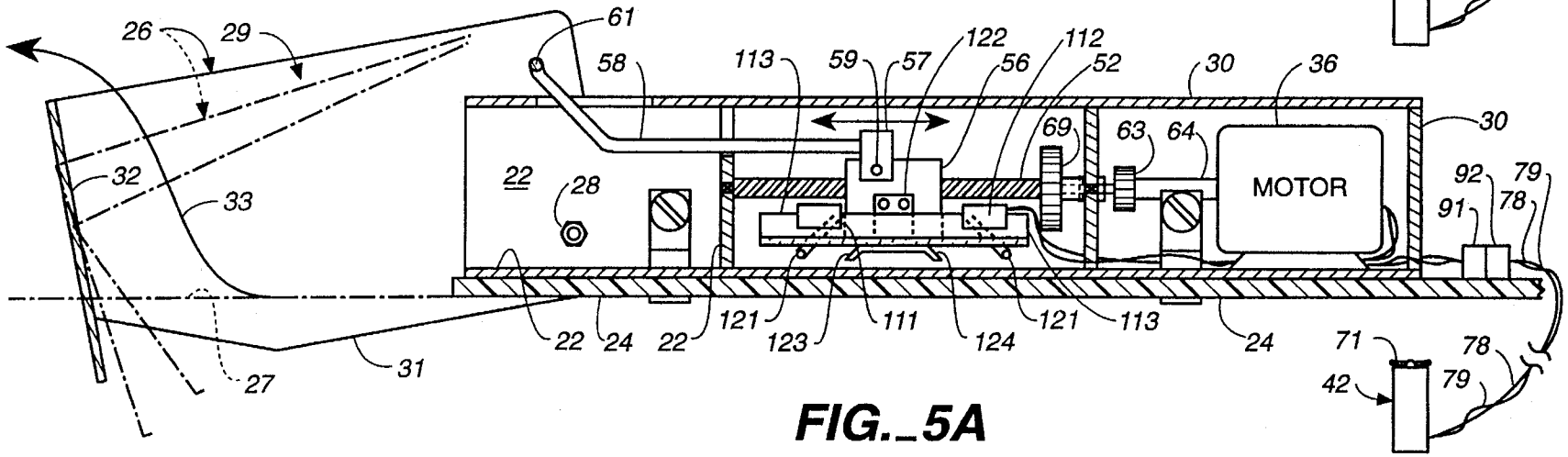
FIG. 5A is a side elevation view, in cross-section, taken substantially along the plane of line 5A—5A in FIG. 2A with the battery assembly removed for ease of understanding.

In order to displace braking blade 26 between the retracted positions of FIG. 5 and a snow-engaging position of FIG. 5A, the present blade assembly is driven by an electrically powered drive assembly. Thus, an electric motor 36 is electrically coupled to at least one, and in this case, a plurality of batteries 38, which are secured to a side wall of framework 22 by a mounting bracket or strap 35. Batteries 38 are shown electrically coupled in parallel to drive a commercially available 7.5 volt, 2 amp motor 36, but it will be understood that other motor, battery combinations and connection schemes can be used in the present invention.

Motor 36 is coupled to batteries 38 through an electric control circuit, generally designated 39, and electrical conductors 37 and 41. Electrical control circuit 39 will be described in more detail in connection with FIG. 6, but circuit 39 is further electrically coupled to a switch assembly, generally designated 42, for example, by conductors 78 and 79 through plug assembly 91. Switch assembly 42 may be manually operated by the skier, and it may be conveniently integrated into or attached to the skier's ski pole or provided as an ergonomically grippable housing member for the ski boarder. While it is possible to employ a radio frequency coupling between switch assembly 42 and electrical circuit 39, it is also less costly to simply run conductor lines 78 and 79 along the skis and then up the skier's pants to the waist, where a single line can extend to switch assembly 42 in the skier's hand.

It is a feature of the present invention that braking blade 26 can be driven into the snow by motor 36 to virtually any depth selected by the skier. Moreover, it is an important feature of the present invention that once adjusted by the skier, braking blade 26 will maintain its position against the reaction braking forces of the snow on blade wall 32.

In order to effect such continuous adjustment and holding of the ski brake in any desired or selected position during skiing, brake assembly 21 preferably includes a blade drive assembly, generally designated 51, which is formed to displace braking blade 26 between the retracted and braking positions in response to operation of motor 36. Drive assembly 51 is further formed to automatically hold the braking blade in the selected braking position once adjusted by motor 36. This is most preferably accomplished by forming drive assembly 51 between motor 36 and blade 26 to include a worm gear 52 mounted for rotation to framework 22, for example, by pivotal mounting of opposite ends of wormgear 52 to transversely extending framework partitions 53 and 54. The wormgear ends are mounted in suitable bearings for rotation and a drive nut 56, which carries an arm 57, is threadably mounted on the worm gear. As best may be seen in FIG. 2 and FIG. 5, drive nut 56 may be formed with a slot 55 which receives the upwardly extending leg of an L-shaped guide flange 60 that prevents rotation of nut 56 on worm gear 52 while allowing axial displacement. A link member 58 is coupled to arm 57, which is mounted to nut 56 for pivotal movement at pivot point 59. The opposite end of link 58 can be pivotally mounted at 61 to an upper edge of the U-shaped braking blade 26.

In order to provide sufficient power to drive blade 31 down into the snow, and further to resist backing of the blade out of the snow, drive assembly 51 preferably includes a set of reduction gears, generally designated 62, mounted between motor 36 and wormgear 52. Reduction gear set 62 can include a pinon gear 63 mounted to motor shaft 64, a pair of gears 66 and 67 mounted on a common shaft 68 through transverse framework partition 54 and a large reduction gear 69 keyed for rotation with worm gear 52.

The inherent friction in the worm gear 52 and reduction gear set 62 will prevent driving of motor 36 backwards under the snow-induced braking force, once the motor operation is terminated. As will be set forth below, termination of motor operation immediately upon release of switch 42 is effected by electrical control circuit 39. Thus, when the control circuit shuts down the motor, drive assembly 51 immediately stops its motion and will resist and prevent backing off of the braking blade 26 from its selected braking position. The skier or snow boarder, therefore, can simply touch switch 42 briefly to rotate worm gear 52 in a direction which either advances or retracts nut 56 and accordingly braking blade 26. As soon as the switch assembly is released, the blade will be held in position by the drive assembly. This allows the skier or snow boarder to make the fine adjustments to the braking force which are automatically held in place once the control switch is released. The skier's hands, therefore, are free to use in a natural manner for dynamic balancing.

As will be seen from FIGS. 5 and 5A, the relative positions of pivotal mounting 61 and pivot 28 provide considerable mechanical advantage, which combines with the gear reduction of the motor, to allow blade 26 to be driven into the snow, notwithstanding the substantial dynamic forces present during skiing.

Figure 6:
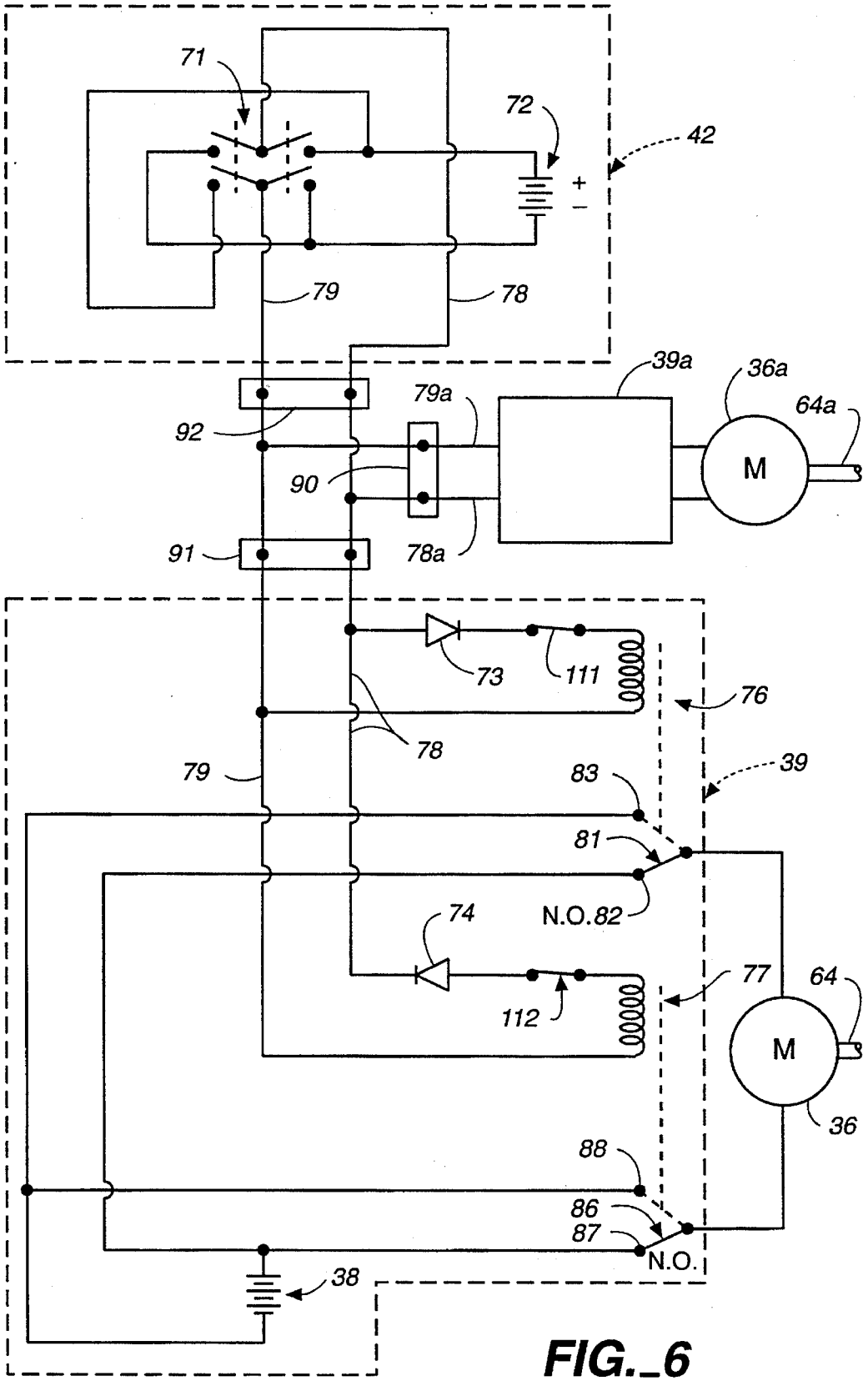
FIG. 6 is a circuit diagram of an electrical control circuit and switch assembly suitable for use with the brake assembly of the present invention.

Referring now to FIG. 6, the construction and operation of control circuit 39 and switch assembly 42 can be described in more detail. Switch assembly 42 preferably is provided by a double-pole, double-throw switch 71 which is biased to the opened position shown in FIG. 6 by spring-biasing means (not shown). Such switch assemblies are well-known in the art. A 9 volt battery 72 is provided at switch assembly 42 and coupled to the double pole, double throw switch in a manner which will effect reversal of the polarity of circuit 39 so as to enable driving of motor 36 in opposite directions.

As Will be seen in FIG. 6, diode 73 and diode 74 control the direction of current flow from battery 72 through relays 76 and 77. When switch 71 is depressed to the right side, as shown in FIG. 6, conductor 78 will be connected to the positive side of battery 72 and conductor 79 will be coupled electrically to the negative side of battery 72. This will allow current to flow through diode 73, but current flow through diode 74 will be blocked. When current flows through diode 73 to relay 76, switch 81 will be pulled from the normally opened (N.O.) contact 82 to contact 83, as shown in broken lines in FIG. 6. This closes the circuit including motor driving batteries 38 and drives motor 36 in a first direction. When switch 71 is released, switch 81 is biased (not shown) to return to the normally opened position in which it contacts terminal 82. As will be seen in FIG. 6, this produces a short circuit across the windings of motor 36 because switch 86 also is biased to normally open (N.O.) contact 87. When the motor windings are short circuited, the motor is heavily loaded and inertial rotation of motor shaft 64 and drive assembly 52 is immediately stopped. When combined with drive assembly 51, the result is that movement of blade assembly 26 also is immediately stopped.

When manually engageable switch 71 is depressed to the left side against the switch biasing spring, conductor 79 will be positive and conductor 78 negative. Current will flow through diode 74 and relay 77, but not through diode 73 and relay 76. The flow of current through relay 77 pulls switch 86 from the normally opened contact 87 to the closed contact 88. Since switch 81 is biased into contact with terminal 82, and switch 86 is now pulled by relay 77 into contact with terminal 88, the flow of current from batteries 38 to motor 36 has been reversed and motor 36 and motor shaft 64 operate in the opposite direction. As soon as switch 71 is released, relay switch 86 is biased to its normally opened position, again producing a short across the motor binding because switches 81 and 86 will be in their solid line positions of FIG. 6.

The result of this circuit is that the switching of switch 71 between the opposite contacts produces a polarity reversal which allows motor 36 to be driven in either of two opposite directions. Moreover, release of switch 77 to the normally opened position results in release of the actuated relay switch (one of switches 81 and 86) so that the motor is short-circuited across the windings and immediately stops. This circuit, therefore, combines with the gear reduction set 62 and the worm gear 52 to immediately stop travel of gear nut 56 and braking blade 26. The skier, therefore, can simply touch switch 71 in either direction to produce a small incremental increase or decrease in braking without inertial overrun.

As thus far described in FIG. 6, circuit 39 and switch assembly 42 are suitable for driving the motor drive assembly on a single ski or on a snow board. When two skis are employed, it is preferable that a second set of conductors **79*a* and 78*a* be coupled to a second control circuit 39*a* to control operation of a second motor 36*a* and output drive shaft 64*a*** for displacement of a second blade on a second ski.

For ease of electrical coupling of the control circuits 39 and **39*a* to a single switch assembly 42, plugs 91 and 90 can be provided proximate the brake assembly housing and a plug 92 provided proximate switch assembly 42. This allows the conductors 78 and 79 to be passed more easily out the user's pant leg to switch assembly 42** carried by the user's hand.

In order to automatically limit the upper-most retracted position and the lower-most braking position, it is further preferable that the present ski brake assembly include limit switches 111 and 112 which can be mounted to a bracket or Z-shaped flange 113 carried by the sidewall 114 of the brake assembly framework assembly 22. Each limit switch can be provided with a mounting groove 120 in a lower side thereof which receives flange 113, and a fastener can be used to allow selective longitudinal positioning and securement of limit switches 111 and 112 as desired along mounting flange 113. As will be seen in FIG. 6, switches 111 and 112 open the relays 76 and 77 to terminate operation of motor 36. Thus, even if the user actuator switch 71 is depressed, the limit switches 111 and 112 prevent over-driving of gear nut 56 in either direction.

As best may be seen in FIG. 5A, each of limit switches 111 and 112 has a downwardly depending arm 121 which is engaged by a actuating member 122 carried by gear nut 56. The actuating member 122 can be provided with oppositely facing tapering surfaces 123 and 124 which engage the switching arms 121. As will be appreciated, other limit switch mounting arrangements can be employed with the brake assembly of the present invention.

Figure 3:
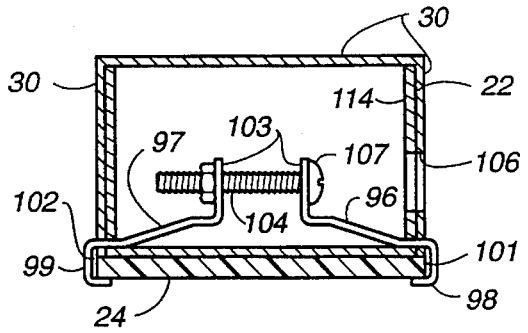
FIG. 3 is an end elevation view, in cross-section, taken substantially along the plane of line 3—3 in FIG. 2.

In order to protect the control circuit, motor and drive assembly from elements, it is preferable that a U-shaped housing or cover 30, FIGS. 1 and 3, be placed over framework 22 and secured thereto by fasteners (not shown). FIG. 3 also illustrates one form of attachment of brake assembly 21 of the present invention to a pair of skis. Clamping brackets 96 and 97 are provided with U-shaped ends 98 and 99, which can be drawn into contact with the sides 101 and 102 of skis 24. The upper ends of brackets 96 and 97 have flanges 103 thereon, and a clamping fastener 104 can be used to pull the two flanges, and accordingly the bracket members, toward each other to effect clamping. Housing 30 and framework wall 114 are provided with an opening 106 which allows access to the fastener head 107 with a tool, such as a screwdriver, to enable pulling of clamping brackets 96 and 97 together.

Figure 7:
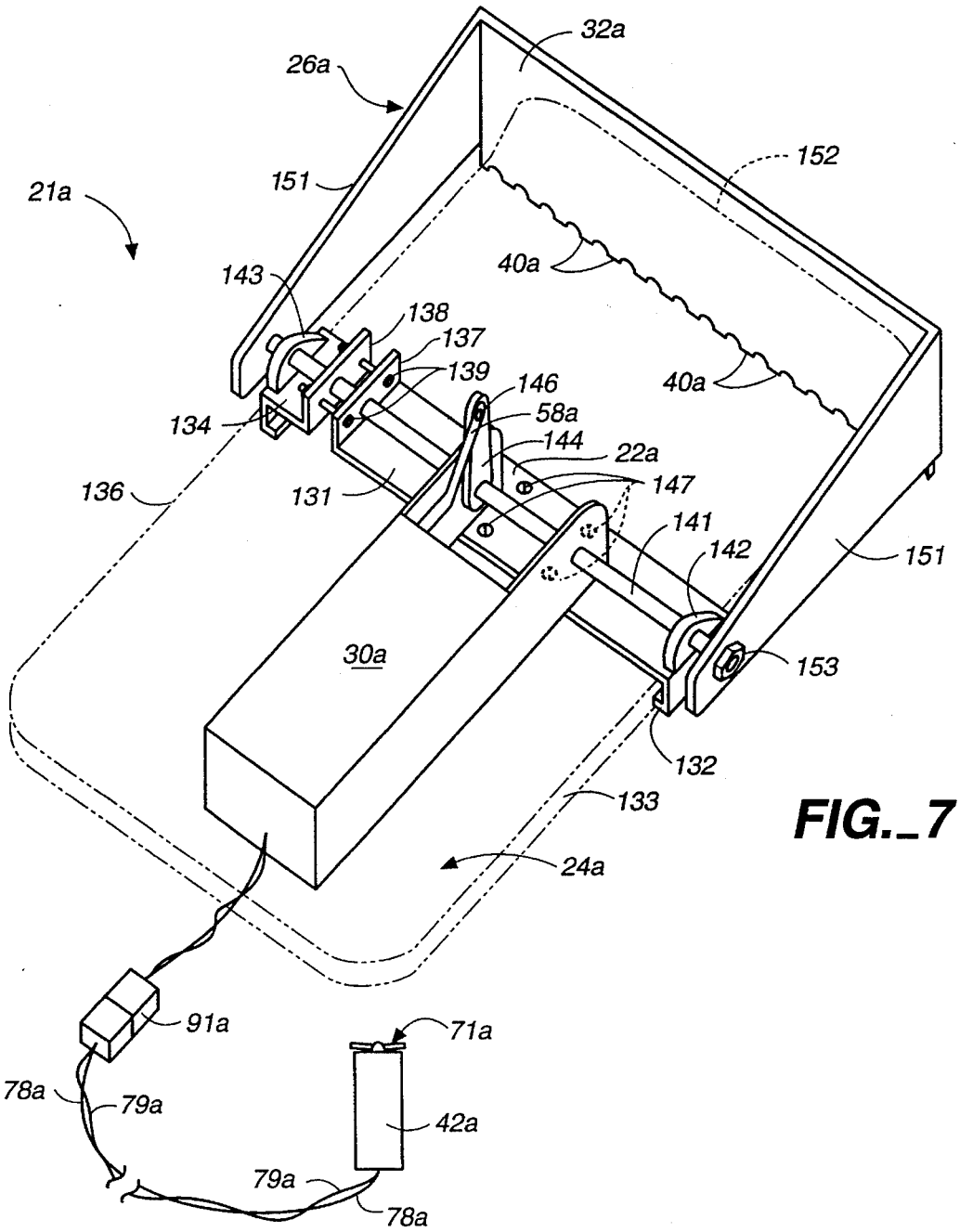
FIG. 7 is a fragmentary, top perspective view of the brake assembly of the present invention as mounted on a snow board.

Referring to FIG. 7, an adaptation of ski brake assembly **21*a* of the present invention for use on a snow board 24*a* is shown. Brake assembly 21*a* can have the same internal motor and drive assembly structure as described in detail in connection with FIGS. 1 through 6. The ski brake assembly in this case, however, is attached to a mounting bracket assembly including a first bracket 131 having a U-shaped end 132 which will grip and engage side 133 of snow board 24*a*. A second bracket 134 grips opposite edge 136 of the snow board, and upstanding flanges 137 and 138 of brackets 131 and 134 can be pulled together by clamping of fasteners 139**.

Extending across snow board **24*a* is a transverse drive shaft 141, which is mounted in bearings 142 and 143 carried by brackets 131 and 134 proximate opposite edges 133, 136 of the snow board. At a location between bearings 142 and 143, a crank arm 144 is keyed to cause rotation of transverse drive shaft 141. The crank arm can be pivotally connected at 146 to link member 58*a* of the ski brake drive assembly. The framework 22*a* of brake assembly 21*a* can be coupled by fasteners 147 to one of the mounting brackets, in this case first bracket 131**.

Again, the braking blade assembly **26*a* preferably takes the form of a U-shaped member having an open top and bottom with a transversely extending blade 32*a* having snow-engaging protrusions 40*a*. The blade assembly arms 151 extend rearwardly to clear the back end 152 of the snow board and are keyed or secured at 153 for rotation with transverse drive shaft 141**.

The operation of brake assembly **21*a* is again controlled by a manually engageable switch 71*a* of switch assembly 42*a* that is coupled through conductors 79*a* and 78*a*, and plug assembly 91*a*, to the motor and battery pack contained housing 30*a*. Operation of the brake for a snow board is identical to that of the snow ski brake, and the advantages of small and rapid incremental adjustment of the depth to which transverse blade member 32*a*** is driven into the snow can be easily controlled.

In the illustrated embodiment, motor 36 can take the form of a 7.5 volt, 2 amp, direct current, permanent magnet motor of the type commonly employed in remote controlled toy cars and vehicles. Such electric motors are reversible and operate at peak speeds of on the order of 20,000 rpm.

What is claimed is:

1. A brake assembly for snow skis and snow boards comprising:

a framework formed for mounting to a body of a ski or snow board proximate a rear end thereof;

a snow-engaging braking blade mounted for movement between a retracted position in which said braking blade is out of contact with the snow and a plurality of distinct braking positions in which said braking blade is in contact with the snow and oriented to effect braking;

an electrical motor;

a battery electrically connected to said electrical motor;

a switch assembly and electrical circuit electrically coupled to control operation of said motor by manual gripping and operation of said switch assembly by a user while skiing; and a blade drive assembly mounted to said framework and coupled between said electrical motor and said braking blade to displace said braking blade between said retracted position and said plurality of braking positions in response to operation of said motor, said drive assembly and electrical motor actuated to displace said braking blade from said retracted position to a selected one of said plurality of braking positions and providing an assembly to hold said braking blade in said selected one of said plurality of braking positions against reaction braking forces upon termination of said electrical motor by a release of the switch assembly by the user.

2. The brake assembly as defined in claim 1 wherein, said braking blade and said electrical motor are both mounted to said framework; and said switch assembly is electrically coupled to said electrical circuit and said electrical motor by conductors having sufficient length to enable said switch assembly to be carried in a hand of a skier while skiing.

3. The brake assembly as defined in claim 1 wherein, said drive assembly includes a worm gear mounted for rotation to said framework and a drive nut threadably mounted on said worm gear for displacement along said worm gear upon rotation thereof, and a link member coupled between said drive nut and said braking blade.

4. The brake assembly as defined in claim 3 wherein, said drive assembly further includes a set of reduction gears mounted between said wormgear and said motor for transmission of rotary forces to said worm gear.

5. The brake assembly as defined in claim 1 wherein, said framework includes a clamping assembly for releasable clamping of said brake assembly to said body, and said framework includes a housing enclosing said motor and drive assembly.

6. The brake assembly as defined in claim 2 wherein, said battery is carried by said framework and said framework includes a housing enclosing said battery, said motor and said drive assembly.

7. The brake assembly as defined in claim 4 wherein, said braking blade is pivoted to said framework at a location proximate said body; and said link member is provided by an L-shaped member pivoted at one end to said drive nut and pivoted at an opposite end and coupled to said braking blade at a spaced distance above pivoting of said braking blade to said framework.

8. The brake assembly as defined in claim 4 wherein, said drive assembly includes a pair of spaced apart limit switches coupled to said electrical circuit and positioned to automatically terminate operation of said motor when said drive nut reaches a maximum retracted position and a maximum braking position.

9. The brake assembly as defined in claim 2 wherein, said motor is a reversible electrical motor with the direction of rotation of a motor shaft being determined by the polarity of current applied to said motor through said electrical circuit;

said switch assembly is provided by a double-pole double-throw switch; and said electrical circuit is formed and coupled to said switch assembly to reverse the polarity of said motor upon switching of said switch assembly.

10. The brake assembly as defined in claim 2 wherein, said switch assembly is resiliently biased to a position causing said electrical circuit to short circuit windings of said electrical motor to terminate motor operation substantially immediately upon the release of said switch assembly.

11. The brake assembly as defined in claim 10 wherein, said motor is formed for operation in opposite directions upon switch of polarity of current supplied by said battery; and said switch assembly and said electrical circuit are formed for selected changing of the polarity of current supplied to said motor.

* * * * *